United States Patent [19]

Moreland et al.

[11] Patent Number: 4,671,463

[45] Date of Patent: Jun. 9, 1987

[54] WATER JET AERATOR WITH FLOW CONTROLLING NOZZLE

[75] Inventors: Gerald W. Moreland, Garden Grove; James E. Moreland, Westminster, both of Calif.

[73] Assignee: Jebadabe International, Inc., Orange, Calif.

[21] Appl. No.: 797,441

[22] Filed: Nov. 13, 1985

[51] Int. Cl.[4] ..... E03C 1/084

[52] U.S. Cl. ..... 239/428.5; 4/542; 128/66; 239/541; 239/579; 251/349

[58] Field of Search ..... 239/428.5, 537–539, 239/541, 579; 123/66; 4/542; 261/DIG. 75; 251/349, 351; 417/176

[56] References Cited

U.S. PATENT DOCUMENTS

| | | | |
|---|---|---|---|
| 2,885,943 | 5/1959 | Divizia | 239/539 X |
| 3,067,435 | 12/1962 | Nash | 261/DIG. 75 X |
| 3,540,438 | 11/1970 | Jacuzzi | 128/66 |
| 4,335,854 | 6/1982 | Reynoso | 239/428.5 |
| 4,408,721 | 10/1983 | Cohen et al. | 239/428.5 X |
| 4,422,191 | 12/1983 | Jaworski | 128/66 X |
| 4,541,780 | 9/1985 | Moreland | 417/176 |

*Primary Examiner*—Andres Kashnikow

*Attorney, Agent, or Firm*—Knobbe, Martens, Olson & Bear

[57] ABSTRACT

A water jet aerator for use in a tub or spa having an eyeball-type nozzle which, when rotated, controls the flow of water through the aerator. The nozzle also can be swiveled to vary the direction of fluid flow into the tub. To prevent injuries due to falling, the nozzle is recessed so as not to protrude beyond the edge of a flanged bushing which clamps the aerator to the tub wall. The nozzle is easily manipulable despite being recessed since no sleeves for controlling fluid flow surround the nozzle. Also disclosed is an embodiment in which rotating the nozzle controls air flow so as to be a function of water flow. During ganged operation of aerators, this prevents the air inlet to the aerator from being open when the water inlet is not sufficiently open to prevent the backflow of water from the tub into the air inlet.

17 Claims, 4 Drawing Figures

Fig. 2
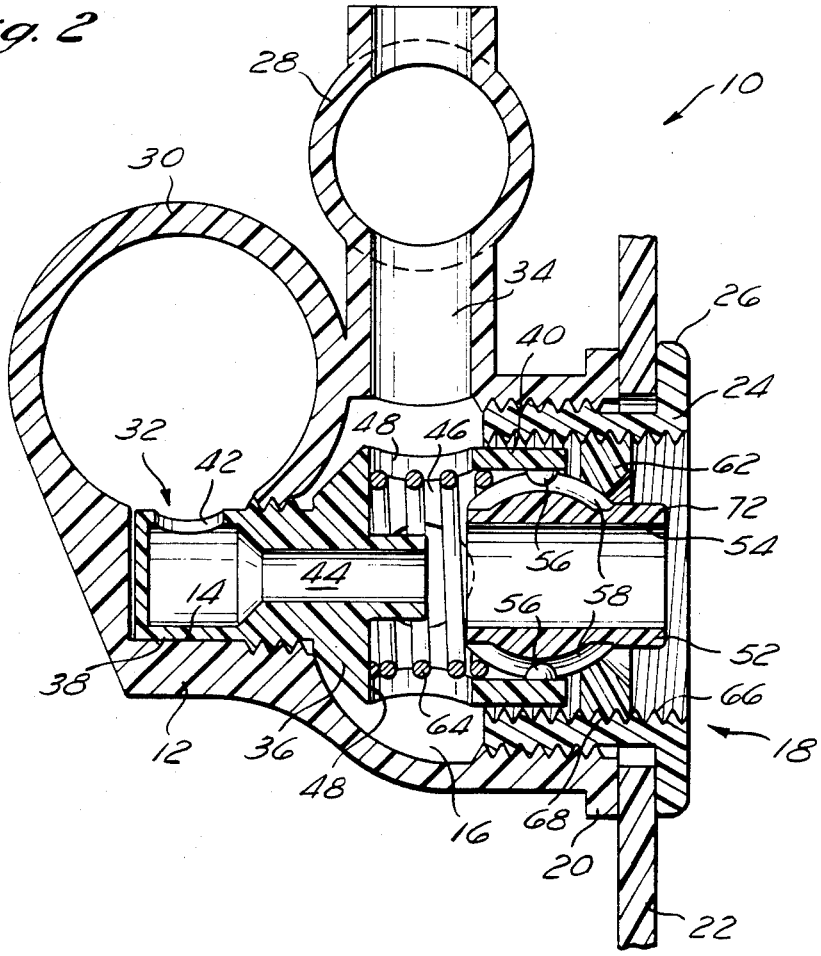
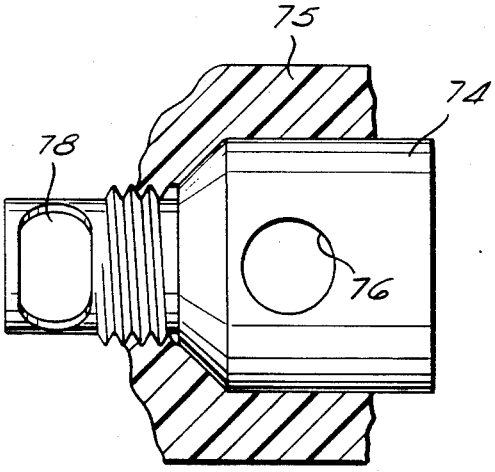
Fig. 3
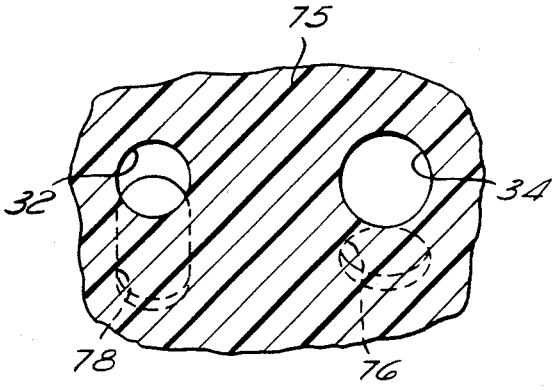
Fig. 4

WATER JET AERATOR WITH FLOW CONTROLLING NOZZLE

BACKGROUND OF THE INVENTION

This invention relates to spas, and more particularly to water jet aerators used in spas or tubs. The disclosure of U.S. patent application Ser. No. 549,663 is hereby incorporated by reference.

Previous aerators have had one of several types of manual flow control systems. The first type controls only the flow of water, while the air flow through the aerator remains on constantly. The second type controls both air and water flow simultaneously, and proportionally. The third type of aerator control allows independent adjustment of both air and water flow.

Typically, the air and water is introduced to the aerator through air and water inlets in the aerator housing. The valves which control air or water flow through their respective inlets consist of tubular sleeves rotatably threaded into the housing. The sleeves have radially positioned air and water ports. By rotating a sleeve relative to the aerator housing, the air and/or water inlets can be opened or closed by the alignment of the ports in the sleeve relative to the inlets in the housing, so the air and water flow can be turned on, off, or proportionally adjusted. In order to independently control air and water, a separate sleeve or valve is required for both the air and the water inlets, as shown in Reynoso (U.S. Pat. No. 4,335,854).

Alternatively, an inlet through the housing and a sleeve having an open end or axial port can be combined to form a needle valve to control air or water flow, as in Jacuzzi (U.S. Pat. No. 3,297,025).

To clamp the aerator to the wall of the tub or spa, a flanged bushing is generally attached to the aerator through a hole in the tub wall. The flange on the bushing thus protrudes into the tub. Additionally, the fluid control sleeves protrude beyond the bushing so that they can be manually rotated to adjust flow. Many aerators utilize swiveling, eyeball-type nozzles to direct the flow into the tub. These nozzles are surrounded by the sleeves, and in order to be manipulable through the end of the sleeve, the nozzles often protrude beyond the flanged bushing also.

These protruding members of the aerator are undesirable because they increase the risk of injury to a person who may slip and fall within the tub. The further the aerator protrudes from the tub wall, the more likely it is that a person will strike the aerator during a fall.

Further, previous aerator designs have been unsatisfactory for applications such as indoor tubs where the size of the aerator is reduced to compensate for space limitations, smaller air and water feed lines, and smaller diameter tub wall holes. As the aerators are reduced in size, there is a limit as to how small the nozzle and surrounding sleeves can be while still being large enough and accessible enough to be manipulable.

Moreover, public health regulations limit the volume of water which may be retained within an aerator after the tub has been drained. To comply with these regulations, it is advantageous to reduce the overall size of the aerator to correspondingly reduce the internal volume of the aerator in which water may be trapped.

Thus, a need exists for a water jet aerator which is capable of being reduced in size and which has manipulable fluid flow controls that do not protrude into the tub.

SUMMARY OF THE INVENTION

Briefly, the present invention comprises a water jet aerator having a housing with an air inlet and a water inlet, and a valve body within the housing which is movable to control the flow of air through the air inlet. The valve body has an aeration chamber in which air and water are mixed, and an air port and a water port which when aligned with the respective inlets in the housing direct both air and water into the aeration chamber. The housing is clamped to a wall by means of a bushing having a flanged end which clamps onto the wall of the tub and threads into the housing.

The aerator further comprises a nozzle having a fluid passage which is in communication with the aeration chamber and tub, to introduce aerated water into the tub. The nozzle is attached to the valve body so that upon manipulation of the nozzle, the valve body will be moved to control the flow of water through the aerator by moving the water port relative to the water inlet. Preferably, the nozzle is also capable of being swiveled so that the direction of flow into the tub can be varied. Also, the nozzle can be recessed within the housing so that it does not protrude beyond the edge of the bushing, thus reducing the risk of injury to anyone falling in the tub.

In the preferred embodiment, the nozzle is attached to the valve body by means of hemispherical pins protruding radially inwardly from the valve body and a plurality of mating grooves on the exterior of a rounded portion of the nozzle. The grooves are aligned so that when the nozzle is rotated about its longitudinal axis, the valve body will also be rotated about its longitudinal axis, thus opening or closing the water inlet.

To further secure the nozzle within the valve body, an annular ring is secured to the bushing and a biasing means, preferably a coil spring, is located within the valve body to force the nozzle into contact with the ring so that a portion of the nozzle protrudes through the center of the ring, making the nozzle accessible to manipulation.

In another preferred embodiment, the flow of both air and water can be simultaneously controlled by rotating the nozzle, and thus the valve body. The air and water ports within the valve body are shaped and placed so that the air inlet is always completely closed when the water inlet is not opened sufficiently to create a pressure in the aeration chamber which prevents backflow of water into the air inlet when the air inlet is open. That is, the air inlet will not begin to open until the water inlet is sufficiently open to lower pressure in the aeration chamber below the pressure at the air inlet. It is possible to have both the air and water inlets partially open simultaneously, but the ports are spaced and shaped such that it is not possible to have a stream of water entering the aeration chamber with the air inlet open when the stream has insufficient velocity to lower the pressure in the aeration chamber sufficiently to eliminate backflow.

BRIEF DESCRIPTION OF THE DRAWINGS

FIG. 2 is a cross-sectional assembly view of the present aerator in its first preferred embodiment.

FIG. 3 is a plan view of the valve body utilized in a second preferred embodiment of the invention, with the surrounding housing shown in cross-section.

FIG. 4 is a view of the housing showing the positioning of the valve body ports (in broken lines) relative to the aerator housing inlets in the second preferred embodiment.

DETAILED DESCRIPTION OF THE PREFERRED EMBODIMENT

Figure 1:
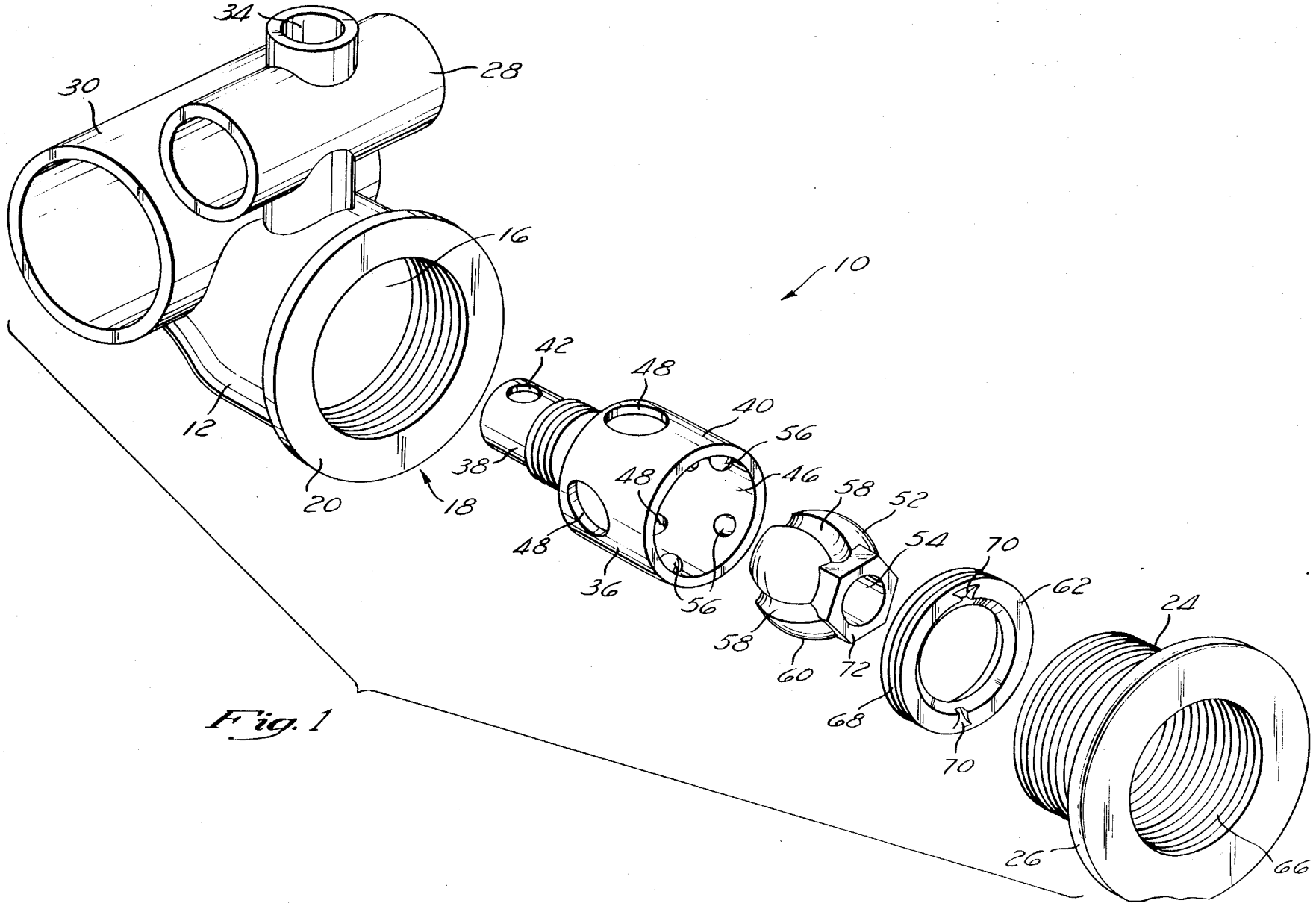
FIG. 1 is an exploded perspective view of a first preferred embodiment of the present water jet aerator.

Referring to FIGS. 1 and 2, a first preferred embodiment of the present water jet aerator 10 includes a housing 12 having a first internal chamber 14 and a second internal chamber 16. The chambers 14 and 16 are substantially cylindrical and have threaded interior walls.

The housing 12 has an open front end 18, as shown in FIG. 1, which leads into the second chamber 16. Surrounding the front end 18 of the housing 12 is a frontal flange 20 which abuts a wall 22 of a tub or spa, as shown in FIG. 2. The housing 12 is clamped to the wall 22 by a bushing 24 which is passed through a hole in the wall 22. The bushing 24 has exterior threading to mate with the threading in the second chamber 16. A flange 26 on the bushing 24 also abuts the wall 22 to clamp the aerator 10 in place.

Preferably, an air conduit 28 and a water conduit 30 are joined to the housing 12. The conduits 28 and 30 are respectively connected to air and water supply lines (not shown). The water conduit 30 feeds into the first chamber 14 through a water inlet 32 in the housing 12, and the air conduit 28 feeds into the second chamber 16 through an air inlet 34 in the housing 12.

A valve body 36 is located within the housing 12 and is utilized to control the flow of water through the water inlet 32, as discussed in more detail below. The valve body 36 is comprised of a first, small diameter tubular portion 38, and a second, larger diameter tubular portion 40. The first portion 38 of the valve body 36 has exterior threading which mates with the threading of the first chamber 14. In its operative position, the valve body 36 is not threaded completely within the housing 12, and thus the valve body 36 is supported by the threads and is rotatable within the housing 12.

A water port 42 in the valve body first portion 38 allows water passing through the water inlet 32 to enter the valve body 36. A central passage 44 in the valve body 36 establishes fluid communication between the water port 42 and an aeration chamber 46 within the valve body second portion 40.

In the embodiment illustrated in FIGS. 1 and 2, a plurality of air ports 48 through the valve body 36 are provided to feed air from the air inlet 34 into the aeration chamber 46. The central water passage 44 terminates within the aeration chamber 46. In the aeration chamber 46, air entering through the air ports 48 becomes entrained within the water flowing out of the central water passage 44. A partially spherical eyeball-type directional nozzle 52 is positioned in the second portion 40 of the valve body 36, at the end of the aeration chamber 46. A fluid passage 54 through the directional nozzle 52 establishes fluid communication between the aeration chamber 46 and the tub so that a stream of mixed air and water can flow out of the aeration chamber 46 and into the tub.

A plurality of hemispherical pins 56 protrude radially inward from the valve body 30 and are engaged within grooves 58 on the exterior of the directional nozzle's 52 rounded portion 60. Preferably, there are a total of four grooves 58 and four mating pins 56, each spaced 90° apart. The grooves 58 are substantially linear and axially aligned so that by rotating the nozzle 52 about the axis of the fluid passage 54, the valve body 36 will also be rotated to control the flow of water through the aerator 10, as discussed in more detail below. Also, the nozzle 52 can be swiveled about two orthogonal axes defined by the two pairs of diametrically opposed pins 56. Preferably, the clearance between the pins 56 and the grooves 58 is sufficiently large to permit the nozzle 52 to swivel freely in all directions. By swiveling the nozzle 52, the direction of flow into the tub can be varied, as is desired.

In order to maintain the nozzle 52 in place, it is biased against an annular ring 62, preferably by a coil spring 64, as shown in FIG. 2. The annular ring 62 is maintained within the bushing 24 by means of threading on the interior surface 66 of the bushing 24, and mating threading on the radially exterior surface 68 of the ring 62. On the face of the ring 62 are a pair of notches 70 which facilitate rotating the ring 62 to thread it into the bushing 24.

The spring 64 forces the nozzle 52 into contact with the ring 62 so that a tip 72 on the nozzle 52 protrudes through the center of the ring 62, allowing the nozzle 52 to be manipulated through the open front end 18 of the housing 12. Preferably, the tip 72 has straight sides which form a hexagon to reduce slippage as the nozzle 52 is grasped. The ring 62 is recessed within the housing 12 so that the tip of the nozzle 52 does not protrude beyond the edge of the bushing 24, as shown in FIG. 2. The recessed position of the nozzle 52 is advantageous in preventing accidental injuries to persons falling within the tub.

The nozzle 52 can be easily removed without disassembling the entire aerator 10 by unthreading the ring 62 from the bushing 24, facilitating the cleaning and replacement of the nozzle 52. The nozzle 52 should be removed periodically to remove deposits which develop on the nozzle's exterior and interfere with the swiveling motion of the nozzle. With the ring 62 removed, the valve body 36 can be easily unthreaded from the first chamber 14 of the housing 12 and removed to permit the clearing of any obstructions to flow through the valve body 36.

In operation, the first embodiment of the aerator 10 permits the flow of water to be controlled simply by grasping the straight sides of the hexagonal tip 72 and rotating the nozzle 52, which directly causes rotation of the valve body 36. When the water port 42 in the valve body 36 is aligned with the water inlet 32 in the housing 12, as shown in FIG. 2, water from the conduit 30 flows into the valve body 36 central passage 44.

The water inlet 32 can be closed to shut off the flow of water through the aerator 10 by rotating the nozzle 52 so that the water inlet 32 is no longer aligned with the water port 42. The flow of water can also be proportionally reduced by rotating the valve body 36 to a position where only a portion of the water port 42 is overlapping the water inlet 32, thus reducing the cross-sectional area of flow through the water inlet 32.

As the valve body 36 is rotated, it threads into the first chamber 14, thus traveling axially toward or away from the front end 18 of the housing 12. However, the nozzle 52 remains in place against the stationary ring 62 regardless of the valve body's travel due to the biasing force of the spring 64.

Alternatively, the water port 42 and water inlet 32 can be shaped to form a needle valve (not shown) at the end of the valve body 36, which would also be controlled by the rotation and resulting axial travel of the valve body 36.

Since the nozzle 52 controls the rotation of the valve body 36, the valve body 36 itself does not have to completely surround the nozzle 52 and extend out the front 18 of the housing 12 to a position where the valve body 36 is manipulable. As a result, the valve body 36 does not surround the nozzle 52 at its tip 72 and the nozzle 52 is easily manipulated through the open front end 18 of the housing 12. Thus, the aerator 10 can easily be reduced in size while still maintaining sufficient room to access the nozzle 52.

There are a plurality of air ports 48 in the valve body 36 of the first embodiment so that rotating the nozzle 52, and thus the valve body 36, will not close off the air inlet 34 or otherwise control air flow. When the water inlet 32 is open, flow is directed into the central water passage 44. Due to the narrowing diameter of the central water passage 44, the water velocity increases along the length of the water passage 44. As a result, a venturi effect is created, which causes pressure to drop in the aeration chamber 46. The pressure differential between the aeration chamber 46 and the air conduit 28, which may be vented the atmosphere, causes air to be drawn through the air inlet 34, and into the aeration chamber 46. Alternatively, air can be forced into the aeration chamber 46 by means of a blower (not shown).

Within the aeration chamber 46, air becomes entrained in the water flow that is exiting the central passage 44. A stream of aerated water then enters the nozzle 52 and is directed into the tub through the nozzle's fluid passage 54. By manually swiveling the nozzle 52 about the pins 56, the flow direction of the aerated water discharged into the tub can be varied.

A second preferred embodiment of the invention is illustrated in FIGS. 3 and 4. FIG. 3 shows an alternate valve body 74 as surrounded by a housing 75, shown in cross-section. The valve body 74 of FIG. 3 includes an air port 76 and a water port 78 which are uniquely shaped and positioned to allow control of both the flow of air and water while facilitating the operation of the aerator 10 in a ganged installation with other aerators. The housing 75 is similar to the housing 12 except that the annular space between the second chamber 16 of the housing 12 and the air ports 48 is eliminated. Thus, flow into the air port 76 is possible only when the air port 76 is aligned with the air inlet 34.

In a typical ganged installation, several aerators 10 are situated around the perimeter of a tub or spa (not shown) to form a circuit. The air conduits 28 of the aerators 10 are joined to a common air manifold (not shown). The air manifold can be vented to the atmosphere at a level above water level in the spa, or can be coupled to the outlet of a blower (not shown). Likewise, the water conduits 30 are coupled to a water manifold (not shown), which is supplied with pressurized water from a water pump (not shown).

Assuming that a first aerator has both its air and water flow turned on, a problem may arise if a second aerator within the circuit has its air inlet 34 open and its water inlet 32 closed or only partially opened. The flow of water through the first aerator will generate a suction in the aeration chamber 46 of the first aerator, due to the venturi effect of the water flowing through the central fluid passage 44. Because the air inlet 34 of the first aerator is open, the suction in the aeration chamber 46 will, through the air manifold, tend to create a backflow of water through the aeration chamber 46 of the second aerator. If the second aerator does not have a sufficient water flow to overcome the static pressure of the water in the tub and create a flow of both air and water out of the second aerator, the suction created by the first aerator will draw water in the tub through the air inlet 34 of the second aerator, and into the air manifold. Once water has entered the air manifold, free air flow through the manifold to the other aerators on the circuit will be blocked, preventing the other aerators from aerating water.

To prevent this occurrence, the air port 76 and water port 78 are shaped relative to each other so that the air inlet 34 can never be in an open position, and thus potentially allowing backflow into the air manifold, unless the water inlet 32 is open sufficiently to ensure flow outwardly from the aeration chamber 36 into the tub.

FIG. 4 is a view through the air and water inlets 34 and 32 of the housing 75, and schematically shows the inter-relationship between the air and water inlets 34 and 32 and the air and water ports 76 and 78 of the valve body 74. While the air inlet 34 is closed, the water inlet 32 can remain partially open. Any rotation of the valve body 74 to open the air inlet 34 will result in a further opening of the water inlet 32, to a position where flow through the water inlet is sufficient to create outflow of air and water from the aerator. There is no position of the valve body 74 in which the air inlet 34 is open, to any degree, and the water inlet 32 is closed. As is best shown in FIG. 3, this result is achieved by an elongated shaping of the water port 78, relative to the air port 76. The geometrical shape of the ports and inlets may be varied, as long as the water port 78 and water inlet 32 are shaped relative to each other so that whenever the air inlet 34 is opened, the water inlet 32 will be opened to a sufficient degree to create a pressure drop within the aeration chamber 46 that will draw air through the air inlet 34, preventing the backflow of water.

What is claimed is:

1. A water jet aerator for introducing a stream of aerated water into a tub or spa, said aerator comprising:

a housing having an open front end, an air inlet and a water inlet;

a valve body movable within said housing, said valve body including an aeration chamber in which air is entrained in a stream of water, said valve body having an air port and a water port, which feed air and water into said aeration chamber, fluid flow into said aeration chamber being controlled by the movement of said valve body relative to said inlets;

a flanged bushing for clamping said aerator to a tub wall, said bushing being coupled to said housing front end;

a nozzle having a fluid passage in communication with said aeration chamber and said tub, said nozzle being positioned within said valve body and manipulable through said housing open end; and means for attaching said nozzle to said valve body so that upon movement of said nozzle, said valve body will be moved to control the flow rate of water, and so that said nozzle can be swiveled relative to said valve body and said housing to vary the direction of fluid flow into said tub.

2. The apparatus of claim 1 wherein said nozzle is recessed within said housing so as not to protrude beyond the edge of said bushing.

3. The apparatus of claim 1 wherein said means for attaching said nozzle to said valve body further comprises a plurality of pins protruding radially inward from said valve body and a plurality of mating grooves on the exterior of a rounded portion of said nozzle, said grooves being substantially linear and aligned so that when said nozzle is inserted in said valve body, axial rotation of said nozzle causes axial rotation of said valve body to control fluid flow through said valve body.

4. The apparatus of claim 3 wherein there are four of said grooves and pins surrounding the nozzle, each being spaced 90° apart.

5. The apparatus of claim 3 wherein said attachment means further includes:

an annular ring in front of said nozzle and secured to said bushing; and a biasing means within said valve body for biasing said nozzle into engagement with said ring so that a portion of said nozzle protrudes through said ring, to enable said nozzle to be manipulated through the open end of the housing.

6. The apparatus of claim 1 wherein said ports and inlets are shaped so that by rotating said nozzle and valve body, and flow of air and water into said aeration chamber can be simultaneously controlled such that each inlet can be simultaneously partially open in at least one position of said valve body, but the air inlet can never be open when the water inlet is open less than a sufficient amount to cause outflow from said aeration chamber into said tub.

7. The apparatus of claim 6 wherein said valve body controls the simultaneous opening and closing of the water and air inlet such that as the water inlet is increasingly open past the predetermined point, the air inlet is also increasingly open as a function of the opening of the water inlet.

8. A water jet aerator for introducing aerated water through a wall in a tub or spa, comprising:

a housing having an open, flanged front end which abuts said tub wall, a first cylindrical chamber and a second cylindrical chamber, each said chamber having threaded interior walls, and a water inlet leading into said first chamber and an air inlet leading into said second chamber;

a flanged bushing threaded into said second chamber through said housing front end, said tub wall being clamped between said housing bushing and said flanged bushing;

a valve body rotatable within said housing to open and close said water inlet, and comprising a first tubular portion having exterior threading to mate with said first chamber threading, and a second tubular portion defining an aeration chamber, a water port within said first tubular portion and an air port within said second tubular portion, said first and second tubular portions being in fluid communication through a central water passage through said valve body, a plurality of pins protruding radially inward from said second tubular portion;

a substantially spherical nozzle having a fluid passage for directing air and water into said tub, said nozzle being positioned within said second tubular portion so that said nozzle fluid passage communicates with said aeration chamber, said nozzle having a plurality of substantially linear, axial grooves on the exterior of said nozzle, said pins being engaged within said grooves to permit said nozzle to be swiveled relative to said valve body to vary the flow direction into said tub and so that rotation of said nozzle causes rotation of said valve body to control the flow of water through said water inlet; and means for retaining said nozzle within said valve body.

9. The apparatus of claim 8 wherein said retaining means permits said nozzle to be removed from and replaced within said valve body.

10. The apparatus of claim 9 wherein said retaining means further comprises:

an annular ring having radially exterior threading which threads into said flanged bushing, a portion of said nozzle protruding through said ring so that said nozzle is manipulable; and a biasing means within said valve body for forcing said nozzle into contact with said ring.

11. The apparatus of claim 10 wherein said biasing means is a coil-spring.

12. The apparatus of claim 8 wherein said housing further comprises an air conduit and a water conduit which feed into said air and water inlets, respectively.

13. The apparatus of claim 8 wherein said second tubular portion includes a plurality of air ports so that air flow through said air inlet and into said aeration chamber cannot be controlled by rotating said valve body.

14. The apparatus of claim 8 wherein said ports and inlets are shaped so that by rotating said nozzle and valve body, the flow of air and water into said aeration chamber can be simultaneously controlled such that each inlet can be simultaneously partially open in at least one position of said valve body, but the air inlet can never be open when the water inlet is open less than a sufficient amount to cause outflow from said aeration chamber into said tub.

15. The apparatus of claim 14 wherein said valve body controls the simultaneous opening and closing of the water and air inlet such that as the water inlet is increasingly open past a predetermined point, the air inlet is also increasingly open as a function of the opening of the water inlet.

16. A water jet aerator for introducing a stream of aerated water into a spa, said aerator comprising:

an aerator housing having a water inlet and an air inlet;

an aerator chamber within said housing for mixing water with air;

a nozzle establishing fluid communication between said aerator chamber and said spa; and a valve body for controlling the introduction of water into said aerator chamber, said valve body having an air port and a water port, said valve being movable relative to said housing so as to bring said inlets into and out of alignment with said ports, said valve moving in response to movement of said nozzle, said nozzle mounted to swivel relative to said valve and said housing to introduce said stream into said spa in different directions.

17. The aerator of claim 16 wherein said housing is clamped to a wall of said spa by a flanged bushing which protrudes into the spa on the one side of said wall and is coupled to said housing on the other side of said wall, wherein no elements of said aerator protrude into said spa further than said flanged bushing.

* * * * *